US006648388B2

(12) United States Patent
Fredriksson

(10) Patent No.: US 6,648,388 B2
(45) Date of Patent: Nov. 18, 2003

(54) SAFETY MEASURES FOR LIFTING SLINGS

(75) Inventor: Lars Fredriksson, Åkersberga (SE)

(73) Assignee: Frenolink Förvaltnings AB (SE)

( * ) Notice: Subject to any disclaimer, the term of this patent is extended or adjusted under 35 U.S.C. 154(b) by 0 days.

(21) Appl. No.: 09/811,154

(22) Filed: Mar. 16, 2001

(65) Prior Publication Data

US 2001/0045756 A1 Nov. 29, 2001

(30) Foreign Application Priority Data

Mar. 16, 2000 (SE) ..... 0000869

(51) Int. Cl.[7] ..... B66C 1/40; B66C 15/00
(52) U.S. Cl. ..... 294/74; 294/82.1; 40/67.3
(58) Field of Search ..... 294/74, 82.1; 40/299.01, 40/673; 116/200, 209, 212

(56) References Cited

U.S. PATENT DOCUMENTS

| | | | | | |
|---|---|---|---|---|---|
| 762,172 | A | * | 7/1904 | Kersten | |
| 3,837,697 | A | * | 9/1974 | Goodrich | 294/74 |
| 3,907,586 | A | * | 9/1975 | Paxto et al. | |
| 3,934,918 | A | * | 1/1976 | Kress et al. | 294/74 |
| 4,094,141 | A | * | 6/1978 | Rehbein | 294/82.1 |
| 4,162,095 | A | * | 7/1979 | Archer | 294/74 |
| 4,185,862 | A | * | 1/1980 | Slocombe | 294/74 |
| 4,245,860 | A | * | 1/1981 | Hinds | 294/74 |
| 4,249,474 | A | * | 2/1981 | Archer | 294/74 |
| 4,789,193 | A | * | 12/1988 | Meals | 294/74 |
| 4,832,391 | A | * | 5/1989 | Moell | 294/74 |
| 5,103,755 | A | * | 4/1992 | Garrett | 294/82.1 |
| 5,193,480 | A | | 3/1993 | Garrett | 294/74 |
| 5,216,923 | A | * | 6/1993 | Brett | 73/827 |
| 5,330,240 | A | * | 7/1994 | Barra | 294/74 |
| 5,537,765 | A | * | 7/1996 | Liebman et al. | 40/664 |
| 5,601,326 | A | * | 2/1997 | Smetz | 294/74 |
| 5,887,923 | A | * | 3/1999 | Gardner, III | 294/74 |

FOREIGN PATENT DOCUMENTS

| | | | | |
|---|---|---|---|---|
| CA | 002052371 | * | 3/1992 | 294/74 |
| DE | 1178984 | * | 10/1964 | 294/74 |
| DE | 0245859 | * | 5/1987 | 294/74 |
| DE | 298 07 051 U1 | | 11/1998 | |
| EP | 0110342 | * | 6/1984 | 294/74 |
| FR | 108409 | * | 9/1943 | 294/74 |
| FR | 1111949 | * | 3/1956 | 294/74 |
| GB | 533584 | * | 2/1941 | 294/74 |
| GB | 925759 | | 5/1963 | |

OTHER PUBLICATIONS

Broderick & Bascom Roper Co., "Yellow Strand", date unknown.*

European Standard EN 818–5 "Short link chain for lifting purposes—Safety—Part 5: Chain slings—Grade 4", Published by European Committee for Standardization, May 1999.

* cited by examiner

*Primary Examiner*—Eileen D. Lillis
*Assistant Examiner*—Paul T. Chin
(74) *Attorney, Agent, or Firm*—Akerman Senterfitt

(57) ABSTRACT

A method of providing a safety measure when lifting a load (13) by a lifting sling (10) with at least two legs (10*a*, 10*b*) connected to the load (13) at two connection points (14*a*, 14*b*). Instead of checking the inclinational angle of each sling leg, in addition to observing the working load limit (WLL), the user can check that the horizontal distance between the connection points does not exceed a Horizontal Length Limit (HLL).

8 Claims, 8 Drawing Sheets

Fig. 5a
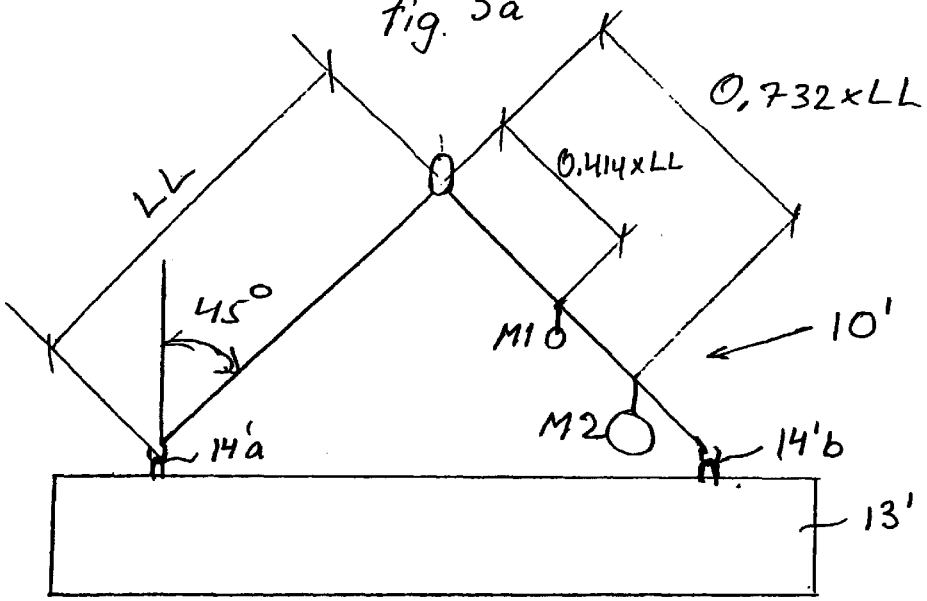
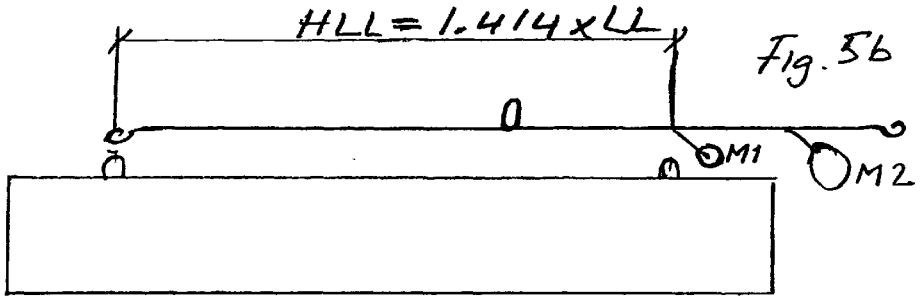
Fig. 5b
Fig. 5c
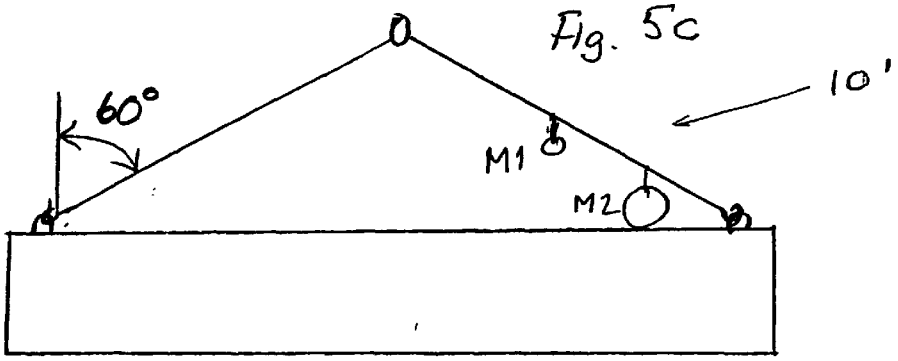
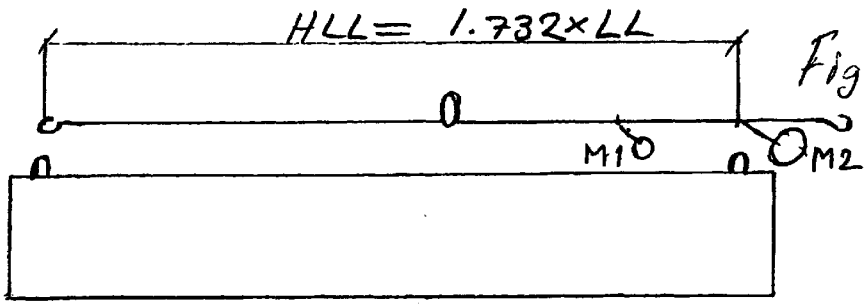
Fig. 5d

SAFETY MEASURES FOR LIFTING SLINGS

FIELD OF THE INVENTION

The present invention relates to safety measures for lifting slings, including a safety method, a lifting sling and a safety tag to be attached to such lifting slings.

BACKGROUND OF THE INVENTION—PRIOR ART

Lifting slings for connecting a lifting device, such as a crane hook, to a load to be lifted are well-known. Such slings are generally constituted by chains, wire ropes or synthetic fiber. Normally, the slings have two, three or four legs of equal length, which are joined together at their upper ends and are coupled to a common, elongated master link assembly, the master link being dimensioned so that it can be hung into the gap of a crane hook.

Each leg of the sling is normally equipped with a terminal attachment fitting, e.g. a hook, an end link or a shackle, for safe connection to the actual load. Alternatively, the lifting sling may be formed as a loop dimensioned to extend around and underneath the load during lifting. Such a loop can be endless, in which case it is directly hung into the crane hook or the like, or it can be connected to a master link assembly at the upper end portions of each leg, which extend between the respective upper end points and the two connection points making mechanical contact with the load during lifting.

For a long time, there has been an established practice that each sling leg, including any fittings at the upper and/or the lower ends of the legs, can be loaded up to a maximum static force for a particular type of sling, e.g. for a specific type of lifting chain (dimension, material quality grade, etc.). This maximum load is the rated Working Load Limit (WLL) for a lifting sling with only one leg (hanging down vertically during lifting).

For multileg slings, this maximum load or WLL is converted to another value for the whole sling. The converted value will depend on the number of legs and the inclinational angle to the vertical (hereinafter called the "angle to vertical") for the legs.

The larger the angle to vertical is, the lower the WLL will be. For safe use, it is normally required that the sling has an attached sling tag marked with the particular WLL for the sling. A common practice has been established, whereby the WLL is rated at the angles of 45 degrees and 60 degrees to the vertical, always under the assumption that the load is symmetrical and equally distributed to the separate legs, i.e. that the angle to vertical is the same for each leg of the sling.

Specific Working Load Limits (WLL) for single chain slings, two-leg chain slings, three- and four-leg chain slings, and endless chain slings (loops) are given in the European Norm EN 818-5:1999 for angles up to 45 degrees and angles between 45 and 60 degrees, respectively. This document also includes examples of Identification tags for such chain slings (Annex D).

However, it has been experienced on the jobsites that it is very difficult to accurately measure the actual angle to vertical. Also, the measuring procedure has to be repeated for every load to be lifted.

If the Working Load Limit (WLL) of a one-leg sling is 1 ton (t), then the corresponding values for a two-leg sling can be easily calculated as follows (corresponding values can of course be calculated also for slings with three or four legs):

| Angle to vertical (degrees) | WLL, two-leg sling(tons) |
|---|---|
| 45 | 1.414 |
| 50 | 1.286 |
| 60 | 1.000 |
| 65 | 0.845 |

As indicated above, the sling tags will indicate the rated values for 45 and 60 degrees. Accordingly, in this case the actual angle is 50 degrees instead of 45 degrees, this measuring error of only 5 degrees will result in an overload on the sling legs of 1.414/1.286−1 which is approximately 10%. On the other hand, if the actual angle is 65 degrees instead of 60 degrees, this measuring error, likewise of only 5 degrees, will result in an overload of 1.000/0.845−1 which is approximately 18%.

Therefore, the measuring errors of the angle to vertical for slings in practical service will either result in overloads up to about 20% or even more, or make it necessary to derate the lifting capacity of the particular lifting sling so as to avoid such overloads.

OBJECT OF THE INVENTION

The main object of the present invention is to achieve an improved and more accurate method for providing an acceptable safety measure when lifting a load by means of a lifting sling coupled to a lifting device as discussed above.

It is also an object of the invention to provide a simple practical means for implementing such an improved method.

SUMMARY OF THE INVENTION

The above-mentioned main object is achieved by introducing the concept of a horizontal length limit (HLL), which is a predetermined maximum limit of the horizontal distance between connection points, which for said load and said sling will result in said static force which may be applied to each sling leg during lifting. In this way, it is no longer necessary to measure the angle to the vertical of the sling legs. Instead, one has to check, in addition to observing the working load limit (WLL), that the maximum horizontal distance between any two connection points does not exceed the given horizontal length limit (HLL). Such a check or measurement is much easier to perform on the jobsite.

The expression "maximum limit of the horizontal distance between connection points" means that the limit is related to the greatest distance between the connection points. In a rectangular configuration (4-leg-sling), the greatest distance is along a diagonal. Moreover, for loads having a complicated or irregular geometry, it may happen that the connection points are not located exactly in the same horizontal plane.

Apart from the improved method, as defined in claim 1, the invention also concerns a lifting sling (claim 8) provided with a safety indicator, such as a tag indicating the working load limit (WLL) as well as the horizontal length limit (HLL), and such a tag (claim 10) to be attached to the associated lifting sling.

The invention will explained further below with reference to the appended drawings.

BRIEF DESCRIPTION OF THE DRAWINGS

FIGS. 5*a* to 5*d* illustrate schematically a two-leg lifting sling provided with markings for checking the maximum load conditions.

DETAILED DESCRIPTION OF PREFERRED EMBODIMENTS

Figure 1:
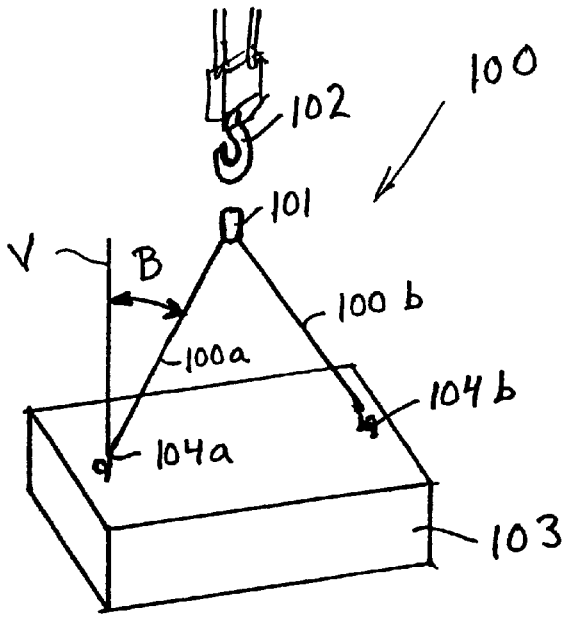
FIG. 1 illustrates schematically a prior art method of determining the load limit for a chain sling with two legs.

In FIG. 1 there is illustrated a two-leg chain sling 100 with two sling legs 100*a* and 100*b*, which are joined together at their top end portions and are connected to a common elongated master link 101. The latter can be hung onto a crane hook 102 of a lifting device, such as a lifting crane. At the bottom end portions, the sling legs are detachably connected to a load 103 by means of terminal attachment fittings 104*a* and 104*b*, e.g. in the form of hooks, end links or shackles.

In order to ensure that the rated maximum work load or Working Load Limit (WLL), as discussed above, is not exceeded, the user has to check, according to a prior art method, that the angle B between the respective sling leg 100*a*, 100*b* and the vertical direction V does not exceed a predetermined angle, normally 45 degrees or 60 degrees. As mentioned above, it is often quite difficult in a practical situation to measure this angle with sufficient accuracy.

Figure 2:
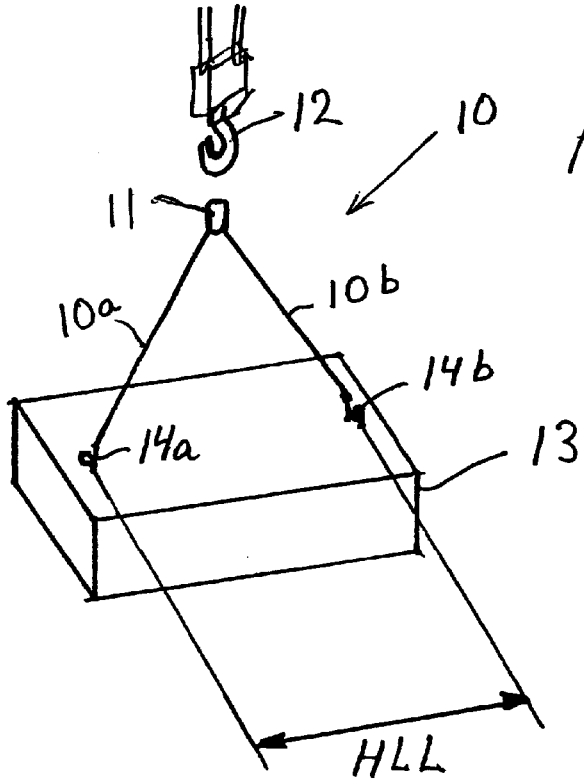
FIG. 2 illustrates schematically the method according to the present invention for determining the load limit for a chain sling corresponding to the one shown in FIG. 1.

In accordance with the present invention, a different measure is taken, namely to check that the horizontal distance between the connection points at the load does not exceed a given value, the so called Horizontal Length Limit HLL, as illustrated in FIG. 2. Here, a lifting sling 10 with sling legs 10*a*, 10*b* is connected to a common master link 11 and a crane hook 12 in the same way as in FIG. 1. Likewise, the sling legs are connected to the load 13 by terminal attachment fittings 14*a*, 14*b*.

The user only has to check that the required horizontal distance between the connection points 14*a*, 14*b*, in a horizontal plane, does not exceed a predetermined value, the Horizontal Length Limit HLL. It will be appreciated that this is equivalent to the conventional criterium that the angle B (FIG. 1) does not exceed a given value, provided that the arrangement is symmetric, i.e. that the two sling legs 10*a*, 10*b* (FIG. 2) are of equal length and that the connection points 14*a*, 14*b* are located in a horizontal plane, so that the tensional load applied to each sling leg is the same.

Figure 3A:
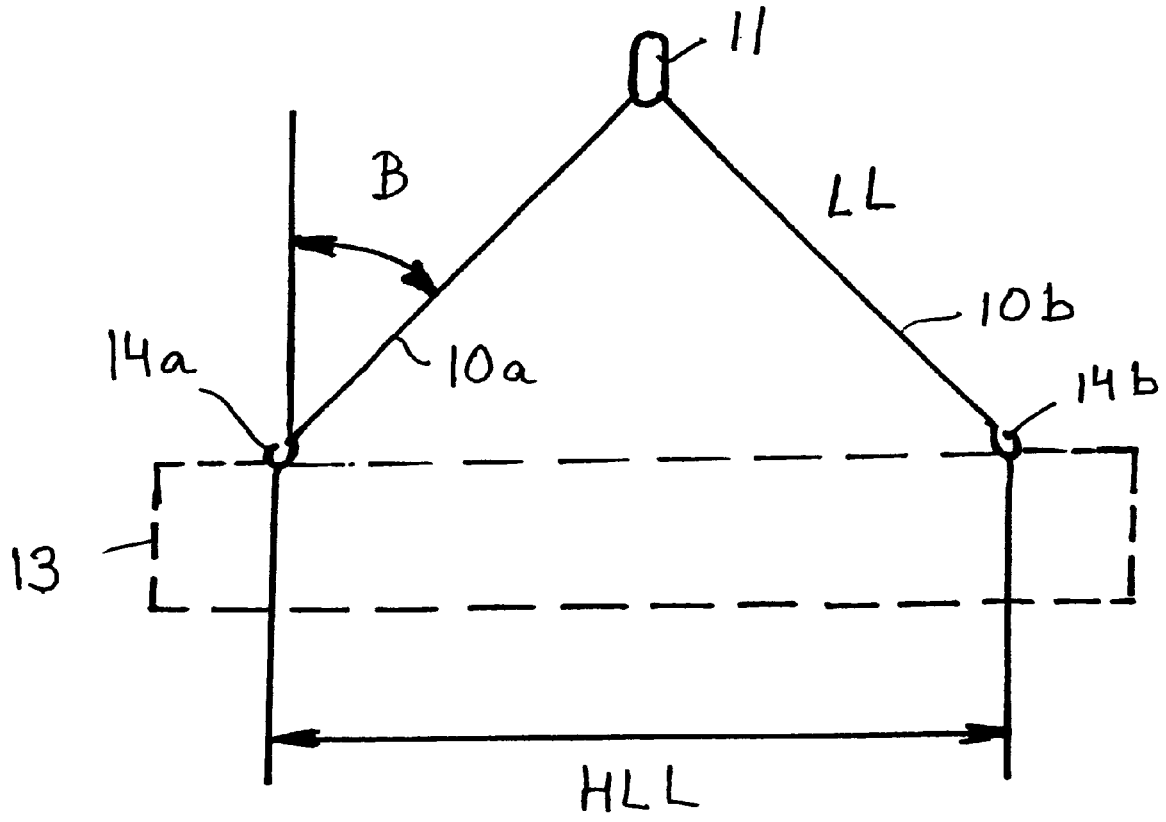
FIGS. 3*a*, 3*b* and 3*c* illustrate schematically the method according to the present invention for a lifting sling with two legs, three legs and four legs, respectively.

The two-leg lifting sling 10 is illustrated schematically also in FIG. 3*a*, in a side view. From this figure, it is apparent that the Horizontal Length Limit HLL is related to the length LL of each leg 10*a*, 10*b* as follows (not taking into account the configuration of the master link assembly):

$$HLL=2*LL*\sin B$$

Figure 3C:
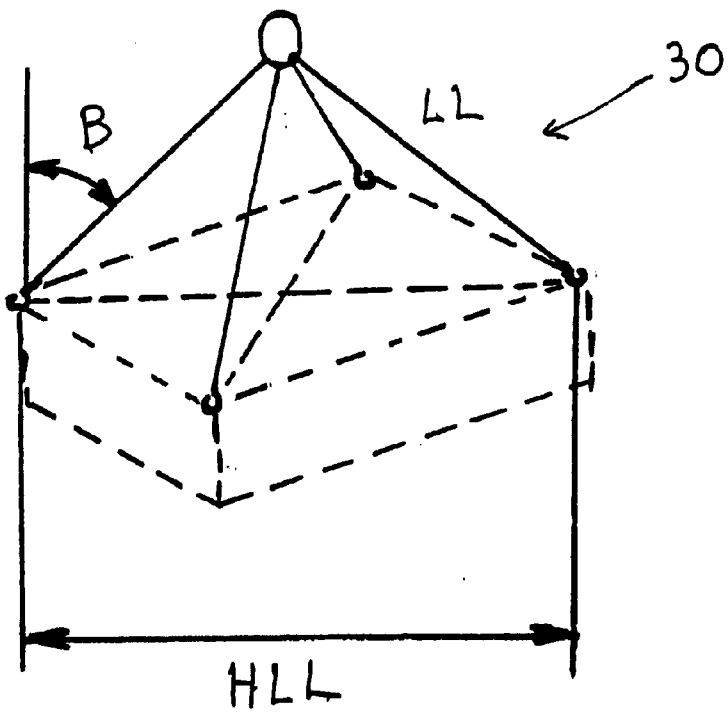
Figure 3B:
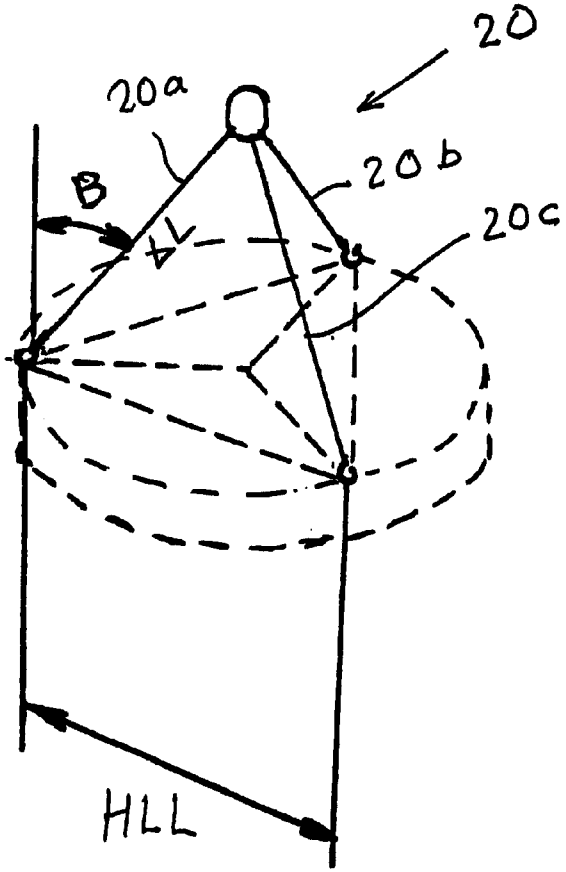

FIG. 3*b* illustrates a lifting sling 20 with three symmetrically arranged legs 20*a*, 20*b* and 20*c*. From the geometry it can be shown that the relation between the HLL and LL is as follows:

$$HLL=2*LL*\sin B*\cos 30°$$

Similarly, for a lifting sling 30 with four legs (the two diagonals being of equal length), as illustrated in FIG. 3*c*, the relation is:

$$HLL=2*LL*\sin B$$

In general, any number of sling legs may be coupled to the load at connection points located in the corners of a regular polygon in a horizontal plane.

So, with the knowledge of the leg length LL of the lifting sling, it is possible to calculate the Horizontal Length Limit HLL by means of the above equations. The HLL values each correspond to a respective maximum angle to vertical B. Therefore, as stated above, it is sufficient for the user to observe the Working Load Limit WLL and the Horizontal Length Limit HLL (instead of the limit of the angle to vertical B).

Those skilled in the art can easily calculate, by elementary geometry, corresponding equations and HLL values for other configurations, including the loop slings being discussed below.

Figure 4A:
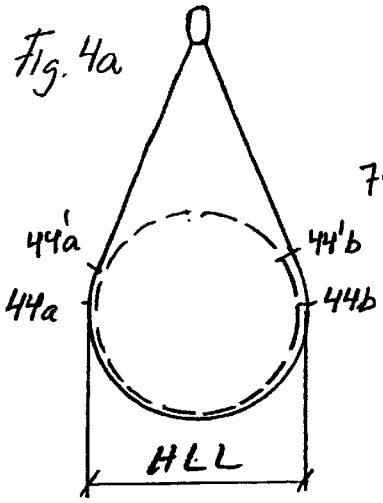
FIGS. 4*a* to 4*g* illustrate schematically various lifting slings with a loop extending around the load (and without a load in FIG. 4*g*)
Figure 4D:
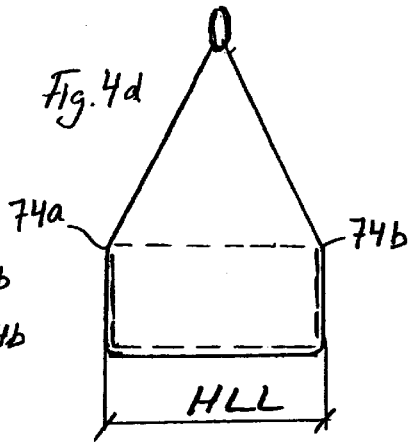
Figure 4G:
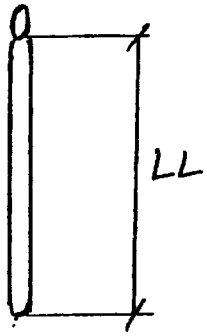
Figure 4B:
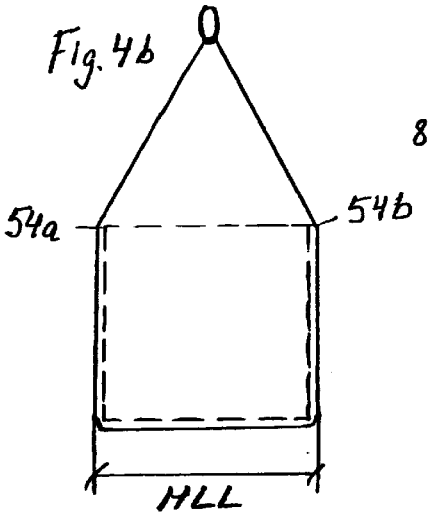
Figure 4E:
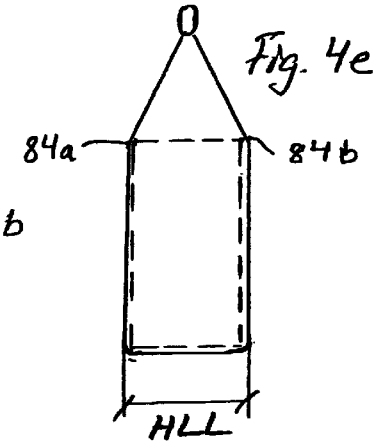
Figure 4F:
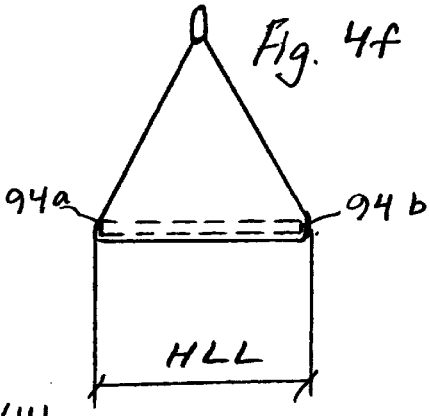
Figure 4C:
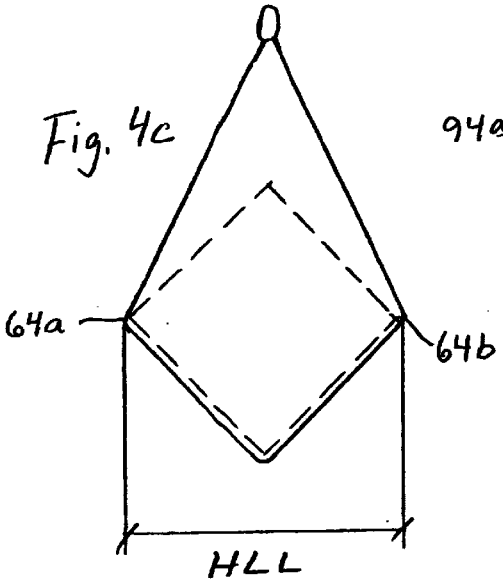

In FIGS. 4*a* to 4*f*, the corresponding Horizontal Length Limit values HLL are shown for a lifting sling in the form of a sling loop extending around and underneath the load. These loops can be single or double. The cross sectional shapes of the loads are circular (FIG. 4*a*), square (FIG. 4*b*), square diagonal (FIG. 4*c*), rectangular (FIG. 4*d*), rectangular standing (FIG. 4*e*), and flat linear (FIG. 4*f*). In all these six cases the connection points 44*a*, 44*b*, . . . , 94*a*, 94*b* are the horizontally most spread apart points where the sling loop makes effective mechanical contact with the load. The distance between these connection points is the Horizontal Length Limit HLL. In these cases, the leg length or rather the "loop length" is defined as the distance between the master link and the lower end of the loop hanging down freely, as shown in FIG. 4*g*.

Of course, the relations between LL and HLL will be different from the equations shown above (and somewhat more complicated).

In the case of a circular cross-section of the load, as shown in FIG. 4*a*, the Horizontal Length Limit HLL is defined as the circular diameter, which is easy to determine, rather than the somewhat shorter distance between the vertically highest connection points 44'*a*, 44'*b*. For practical reasons, the HLL should be easy to find out, without complicated calculations for each load.

FIGS. 5*a*, 5*b*, 5*c*, 5*d* illustrate a two-leg lifting sling 10' with two markings M1, M2, e.g. of a specific color, at certain distances from the master link. These instances, 0.414*LL and 0.732*LL, are such that they can be used to check that the actual distance between the connection points 14'*a*, 14'*b* at the load 13' does not exceed the Horizontal Length Limit HLL, as Illustrated in FIGS. 5*a*, 5*b* (for an equivalent angle to the vertical of 45 degrees) and in FIGS. 5*c*, 5*d* (for an equivalent angle to the vertical of 60 degrees). The lifting sling is simply stretched out on the load for comparison of the sling length 1.414LL (or 1.732LL) and the distance between the connection points 14'*a* and 14'*b*. If the sling length is longer than said distance, it is safe to lift the load with the lifting sling.

Corresponding markings can be attached to three-leg-slings and four-leg-slings, the lengths then being 1.225 LL (at 45°) and 1.5 LL (at 60°) for a three-leg-sling and 1.414 (at 45°) and 1.732 LL (at 60°) for a four-leg-sling.

Figure 6B:
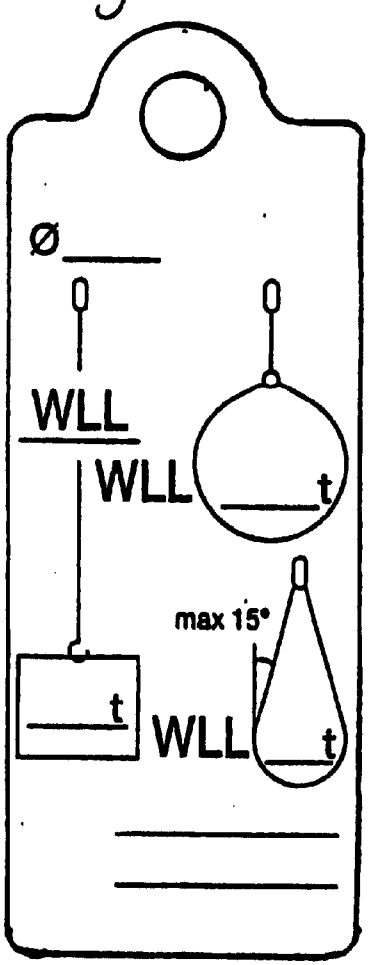
FIGS. 6*a*, 6*b*, 7*a*, 7*b*, 8*a* and 8*b* show three different safety tags to be attached to associated lifting slings.
Figure 6A:
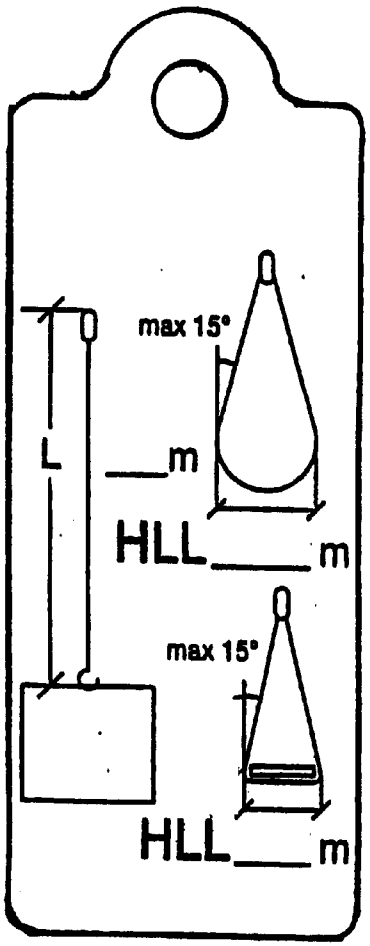
Figure 7B:
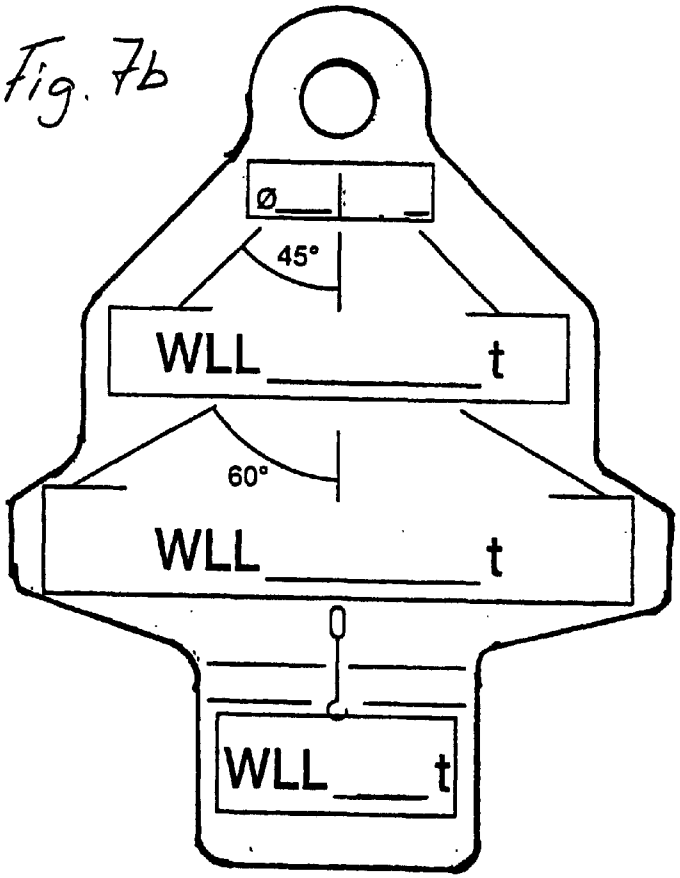
Figure 7A:
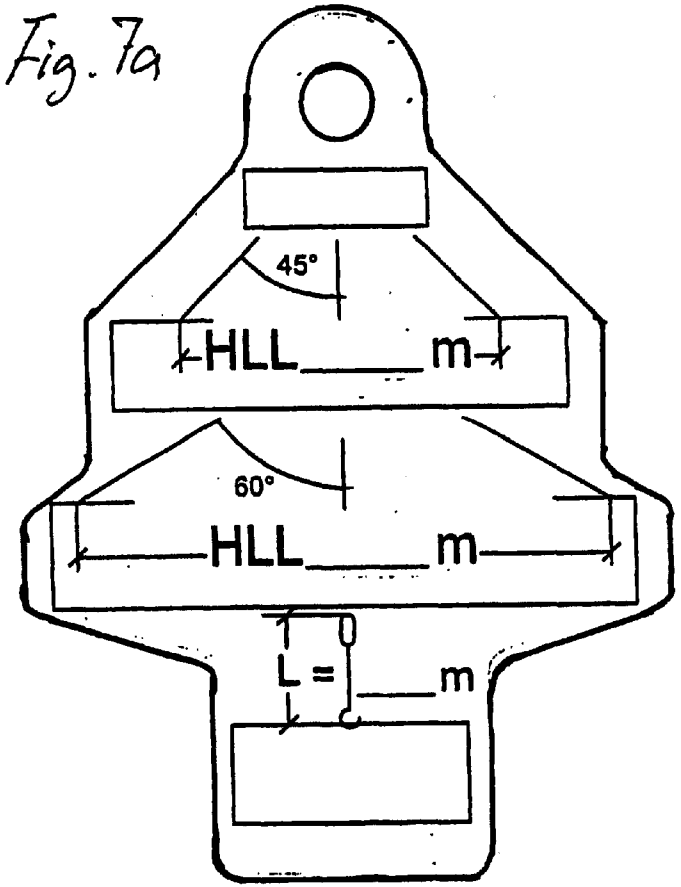
Figure 8B:
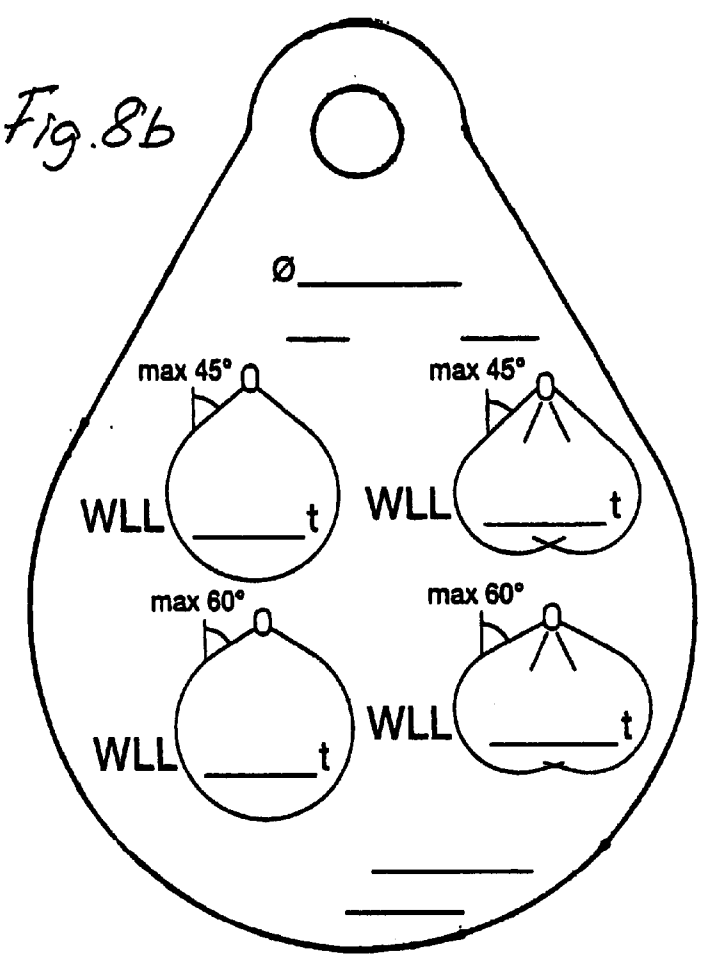
Figure 8A:
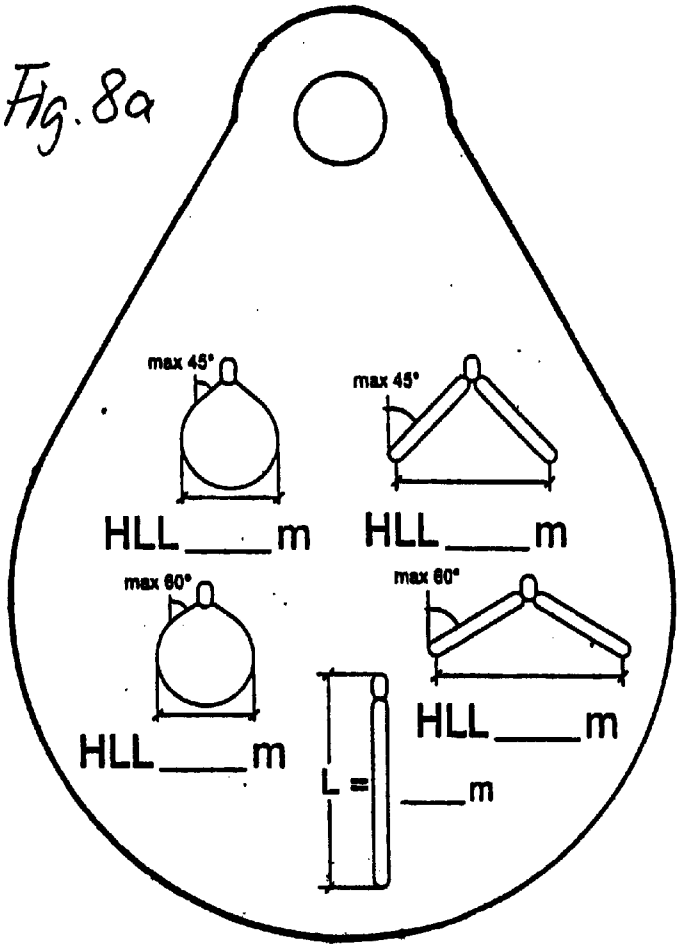

A convenient way of facilitating the safety check to the user is to attach a tag to the lifting sling. Such tags are illustrated in FIGS. 6*a*, 6*b* for a one-leg sling, in FIGS. 7*a*, 7*b* for two-to-four-leg-sling, in FIGS. 8*a*, 8*b* for a loop-formed sling, respectively. On one side of the tag, the Working Load Limit WLL is indicated, and on the other side of the tag, the respective Horizontal Length Limit HLL is shown, corresponding to angles to the vertical of 45 degrees and 60 degrees. If the weight of the load is lower than the WLL and the (greatest) distance between the connection points does not exceed the HLL (both values corresponding to either 45 degrees or 60 degrees), it is safe to carry out the lifting operation.

The tag can be replaced by some other indicator, e.g. a color marking or a special pattern or the like, indicating the Work Load Limit WLL as well as the Horizontal Length Limit HLL.

In actual cases, of course, there may be loads having a very complicated geometry such that the connection points will not be well defined, e.g. if the load is not rigit but made of resilient material. Normally, however, the connection points will approach each other in such a case, and there will be no risk of sling breakage.

What is claimed is:

1. A method for providing a safety measure for lifting a load using a lifting sling coupled to a lifting device, the lifting sling having at least two sling legs connectable to a load at associated connection points and carrying the load during lifting, said method for providing the safety measure comprising the steps of:

observing a working load limit (WLL) corresponding to a predetermined maximum value of a static force permitted for each sling leg during lifting; and observing a predetermined maximum horizontal length limit (HLL) of the horizontal distance between said connection points which will result in safe lifting of the load at or below said predetermined maximum static force which may be applied to the sling during lifting.

2. A method as defined in claim 1, wherein said lifting sling comprises two sling legs connectable to the load at connection points located at opposite ends of a straight line in a horizontal plane.

3. A method as defined in claim 1, wherein said lifting sling comprises at least three sling legs connectable to the load at connection points located at the corners of a regular polygon in a horizontal plane.

4. A method as defined in claim 1, wherein said lifting sling comprises at least two sling legs to be connected to the load at sling leg end portions provided with terminal attachment fittings, said fittings being located at said connection points.

5. A method as defined in claim 1, wherein said lifting sling comprises a loop which is positionable so as to extend around and underneath the load during lifting, the associated connection points for said loop being the two horizontally most spread apart points where the loop makes effective mechanical contact with the load during lifting.

6. A method as defined in claim 1, further comprising the step of attaching a safety indicator, indicating said horizontal length limit (HLL) and said working load limit (WLL), to said lifting sling.

7. A method as defined in claim 1, wherein at least one of said sling legs is provided with a marking at a predetermined position, the method further comprising the step of checking, by stretching the sling legs into a rectilinear configuration before lifting, that the largest distance between said connection points does not exceed said horizontal length limit (HLL).

8. A lifting sling for coupling to a lifting device, said lifting sling comprising:

at least two sling legs for connection to a load at associated connection points and carrying said load during lifting; and an associated safety indicator indicating a predetermined maximum horizontal length limit (HLL) of the horizontal distance between said connection points which for said sling will result in safe lifting of the load at or below a predetermined maximum static force which may be applied to each sling leg during lifting, wherein said associated safety indicator comprises a safety tag attached to said lifting sling.

wherein said safety tag indicates said working load limit (WLL) as well as said horizontal length limit (HLL).

* * * * *